US005307739A

United States Patent [19]

Gourdol

[11] Patent Number: 5,307,739

[45] Date of Patent: May 3, 1994

[54] PRESS FOR TREATING HETEROGENEOUS WASTE PRODUCTS

[75] Inventor: Jacques Gourdol, Varces-Allieres-Risset, France

[73] Assignee: Neyrpic Framatome Mecanique, Courbevioie, France

[21] Appl. No.: 735,311

[22] Filed: Jul. 24, 1991

[30] Foreign Application Priority Data

Jul. 26, 1990 [FR] France ..... 90 09577

[51] Int. Cl.[5] ..... B30B 9/06

[52] U.S. Cl. ..... 100/98 R; 100/127; 100/131; 100/188 R; 100/218; 100/232

[58] Field of Search ..... 100/98 R, 126, 127, 100/130, 179, 249, 251, 218, 131, 188 R, 232, 95

[56] References Cited

U.S. PATENT DOCUMENTS

| | | | |
|---|---|---|---|
| 1,004,214 | 9/1911 | Stehlin | 100/98 R |
| 1,971,546 | 8/1934 | Tuttle | 100/130 |
| 2,644,393 | 7/1953 | Harden | 100/127 |
| 2,705,916 | 4/1955 | Millgard | 100/95 |
| 3,980,014 | 9/1976 | McEwen et al. | 100/127 |
| 4,421,022 | 12/1983 | Burgin | 100/127 |
| 4,665,817 | 5/1987 | Simpson | 100/98 R |

FOREIGN PATENT DOCUMENTS 2615444 11/1988 France .

*Primary Examiner*—Philip R. Coe
*Assistant Examiner*—Reginald L. Alexander
*Attorney, Agent, or Firm*—Pollock, Vande Sande & Priddy

[57] ABSTRACT

The press comprises a frame (1), a feed zone (3) for receiving the waste products to be treated, a press chamber (9) comprising an inlet opening (10) and an outlet opening (11) which are opposed and disposed coaxially relative to the feed zone (3), and a chamber (14) for discharging the solid phase. The press further comprises an element (15) which is transversely movable relative to the axis of the press chamber (9) between a first position for closing the outlet opening (11) and a second position for opening the outlet opening (11), and an arrangement (20) for separating leakages of the liquid phase from the solid phase in the discharge chamber (14).

5 Claims, 5 Drawing Sheets

PRESS FOR TREATING HETEROGENEOUS WASTE PRODUCTS

FIELD OF THE INVENTION

The present invention relates to a press for treating heterogeneous waste products.

BACKGROUND OF THE INVENTION

In recent years, the increasing volume of waste products and in particular household refuse or garbage has made it necessary to search for solutions permitting the treatment and recycling of these waste products.

It has already been envisaged to employ such waste products as fuel, but the presence in these waste products of a high content of water and incombustible products results in only an insufficient amount of energy.

Indeed, such waste products are constituted by a liquid phase which only contains organic products and a solid phase which contains metallic, mineral and synthetic materials.

One solution consists in compressing these waste products so as to obtain both residues which are dry enough to constitute a fuel having acceptable calorific power, and fluid substances utilizable, according to their type, in agriculture as ground modifying products or as raw materials from which chemical products may be extracted.

Devices for compressing these waste products are already known and mostly consist of hydraulic presses including a feed zone receiving the heterogeneous waste products to be treated, a press chamber connected to means for recovering the liquid phase, and a chamber for discharging the solid phase located on the downstream side of the press chamber, which comprises an inlet opening and an outlet opening and has a section equal to that of a piston of a first jack or ram.

The wall of the chamber comprises a multitude of perforations communicating with a passage for discharging the liquid phase extracted by compression of the waste products.

The outlet opening of the press chamber is usually closed by a plug carried by a rod of a second jack or ram opposed to the first-mentioned jack.

The pistons of the two jacks are movable in a reciprocating manner between a first position of compression of the waste products and discharge of the liquid phase during which the piston of the first jack enters the press chamber and the piston of the second jack closes the outlet opening of said chamber, and a second position of discharge of the solid phase during which the piston of the first jack continues its travel and the piston of the second jack opens the outlet opening of the press chamber.

This type of press has drawbacks, and in particular presents problems as to the maintenance of the seal between the press chamber and the solid phase discharging chamber.

Indeed, bearing in mind the considerable forces involved when pressing the waste products, the seal is not fully achieved at the outlet opening of the press chamber by the piston of the second jack, so that leakages of liquid occur and enter the solid phase discharging chamber.

These leakages therefore have the effect of re-wetting the solid phase at the moment of its discharge, and this reduces the advantages of such a press, since separation of the phases of which the waste products are composed is not completely achieved.

Further, bearing in mind the long travel of the piston of the second jack, the response time of the second jack is relatively long and does not permit obtaining rapid rates of operation.

SUMMARY OF THE INVENTION

An object of the present invention is to avoid these drawbacks and to provide a press which is simple to construct and yet permits obtaining dry products having a calorific power distinctly greater than that of products obtained with prior art presses.

The invention therefore provides a press for treating heterogeneous waste products comprising a solid phase and a liquid phase, said press comprising:

a frame, a feed zone for receiving the heterogeneous waste products to be treated, which is open adjacent to the upper end thereof and comprises two lateral opposed openings having a section adapted to the section of a compression piston which is movable between one of the openings of the feed zone and a position beyond the other opening of the feed zone, a pressing chamber comprising an inlet opening and an outlet opening which are opposed and disposed coaxially relative to the feed zone, the chamber having a section equal to the section of the compression piston and comprising calibrated passages connecting the press chamber to means for recovering the liquid phase, and a chamber for discharging the solid phase located on the downstream side of the pressing chamber.

The press further comprises:

an element having a shape complementary to the shape of the discharging chamber and movable transversely relative to the axis of the press chamber between a first position for closing the outlet opening of the press chamber during compression of the heterogeneous waste products, and a second position for opening the outlet opening for extracting the solid phase from the press chamber, and means for separating leakages of the liquid phase from the solid phase in the solid phase discharging chamber.

According to other features:

the transversely movable element is formed by a slide controlled by a jack and guided by slideways connected to the frame, the lower part of the slide comprises blades for cleaning the walls of the discharging chamber, the separating means comprise a pivotable flap, the pivotable flap pivots between a first position which puts the discharging chamber in communication with the means for recovering leakages of the liquid phase during the compression of the heterogeneous waste products in the press chamber, and a second position which puts the discharge chamber in communication with the means for recovering the solid phase during extraction of the solid phase from the press chamber.

BRIEF DESCRIPTION OF THE DRAWINGS

Further features and advantages of the invention will be apparent from the following description of an embodiment of the invention, with reference to the accompanying drawings given by way of example and in which.

DESCRIPTION OF PREFERRED EMBODIMENT

Figure 1:
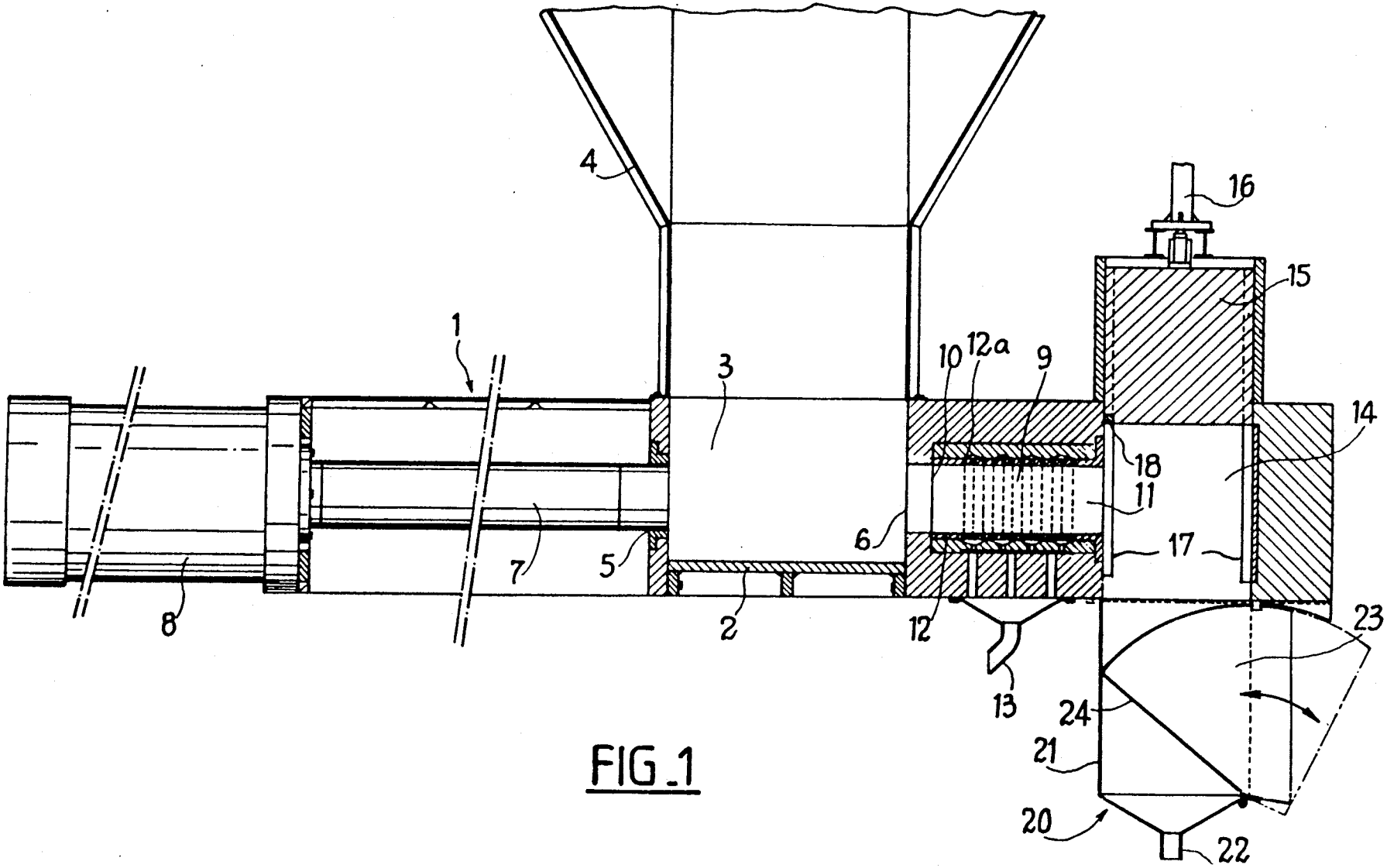
FIG. 1 is a schematic longitudinal sectional view of a press arranged in accordance with the invention.
Figure 2:
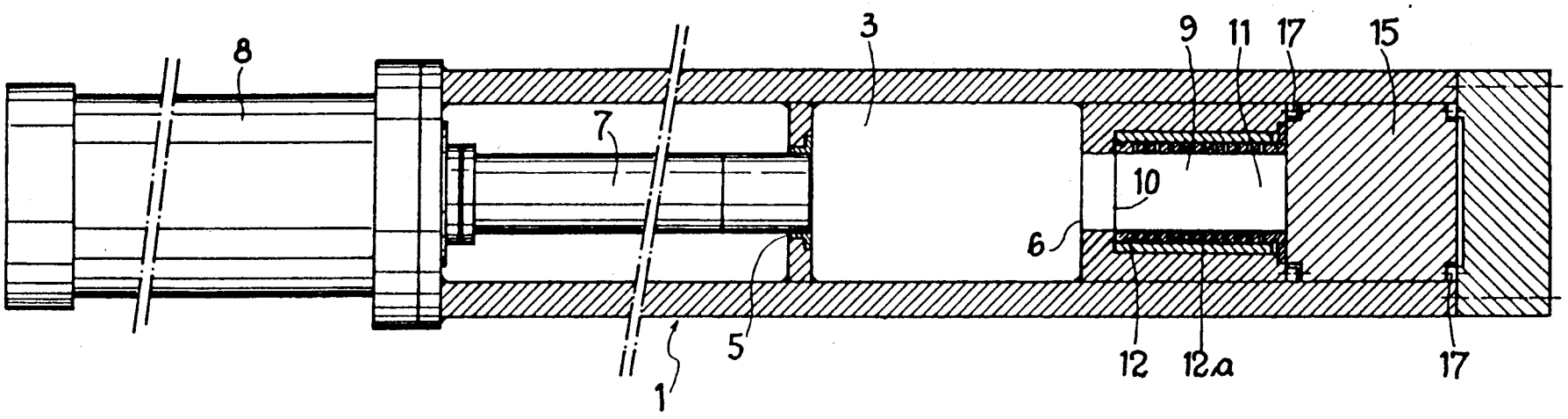
FIG. 2 is a top plan view of FIG. 1.

The press shown in FIGS. 1 and 2 comprises a frame 1 carrying a container 2 forming a feed zone 3 of the heterogeneous waste products.

For this purpose, the feed zone 3 is open adjacent to the upper end thereof and surmounted by a hopper 4 equipped with at least one rammer (not shown) for introducing the waste products into feed zone 3.

This feed zone 3 defines two opposed lateral openings 5 and 6 having a section adapted to the section of a compression piston 7 of a jack 8, for example a hydraulic jack, carried by the frame 1.

The piston 7 is movable between the opening 5 and a position located beyond the other opening 6 of the feed zone 3.

The opening 6 of the feed zone 3 communicates with an annular press chamber 9 which is coaxial with the feed zone 3 and has a section equal to the section of the piston 7. This press chamber 9 comprises two opposed lateral openings 10 and 11.

The press chamber 9 comprises an internal sleeve 12 provided with a multitude of small calibrated passages 12a which place the interior of the press chamber 9 in communication with means for recovering the liquid phase through a funnel 13.

The press chamber 9 communicates through the outlet opening 11 with a chamber 14 for discharging the solid phase of the waste products.

Mounted in the discharging chamber 14 is an element movable transversely relative to the axis of the press chamber 9.

This movable element is formed by a slide 15 having a shape complementary to the shape of the discharging chamber 14.

The slide 15 is moved by the action of a jack 16, for example a hydraulic jack, between a first position for closing the outlet opening 11 of the pressing chamber 9 and a second position for opening said opening 11.

In the course of its displacement, the slide 15 is guided by slideways 17 connected to the frame 1.

Further, the slide 15 comprises, in the lower part of its sides in contact with the walls of the discharging chamber 14, blades 18 for cleaning the walls of the chamber in the course of the displacement of the slide.

The press comprises below the discharging chamber 14 means 20 for separating leakages of liquid phase flowing through the outlet opening 11 of the chamber from the solid phase.

These means 20 comprise a box 21 having a bottom provided with an orifice 22 and lateral walls one of which defines an opening 23.

Mounted in the opening 23 is a flap 24 which is pivotable between a first position putting the discharging chamber 14 in communication with means (not shown) for recovering leakages of liquid phase through the orifice 22, and a second position putting the discharging chamber 14 in communication with means (not shown) for recovering the solid phase through the opening 23.

The press described hereinbefore operates in the following manner:

The heterogeneous waste products to be treated are introduced into the hopper 4 and urged into the feed zone 3, for example by means of a rammer (not shown).

At the beginning of the treatment cycle and in order to permit the introduction of the waste products into the feed zone 3, the piston 7 is in a withdrawn position, as shown in FIGS. 1 and 2.

Figure 3:
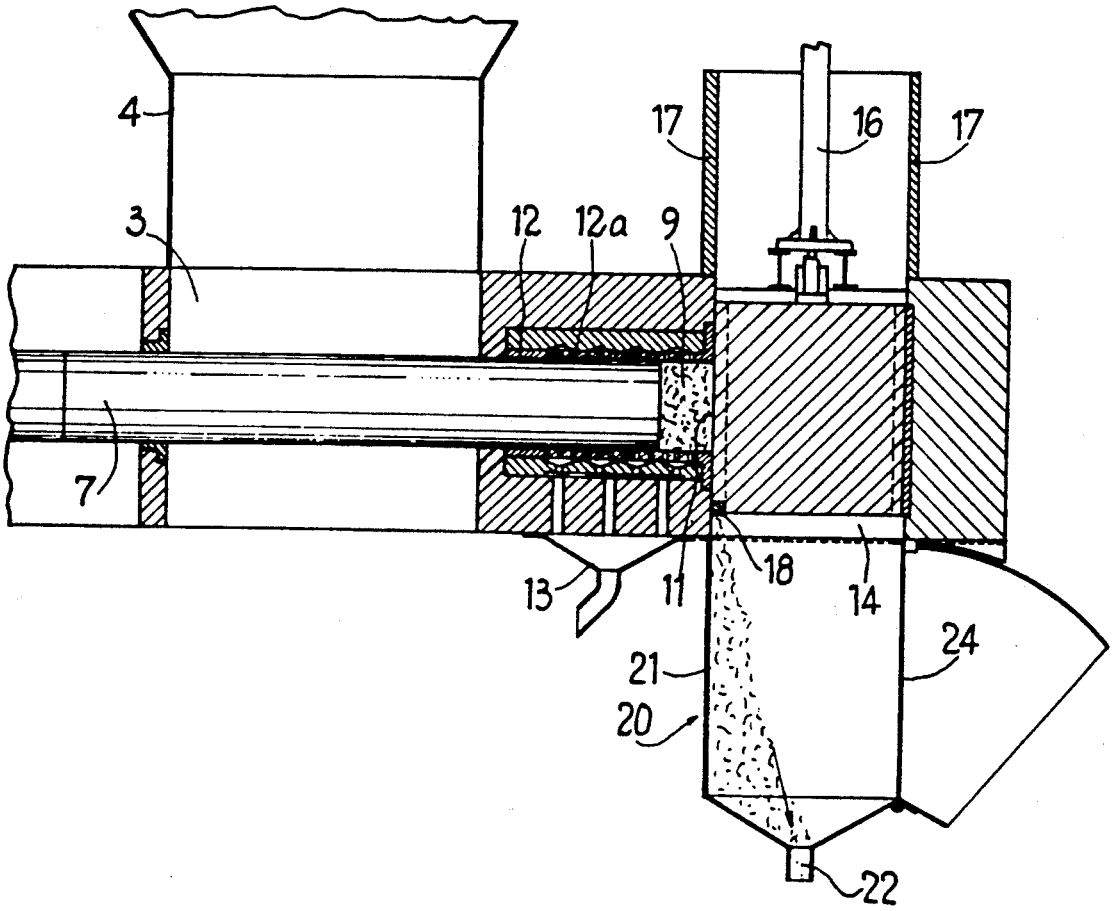
FIG. 3 to 5 are schematic sectional views of the different stages of the operation of the press according to the invention.

The slide 15 is placed in its lower position by the action of the jack 16 and closes the outlet opening 11 of the press chamber 9 and the flap 24 pivots in such manner as to close the opening 23 and clear the orifice 22 (FIG. 3).

Thereafter, the piston 7 controlled by the jack 8 is moved toward the press chamber 9 and urges the waste products contained in the feed zone 3 toward the chamber 9.

In continuing its travel, the piston 7 urges the waste products into the press chamber 9 until a high pressure is obtained and compresses the waste products in the chamber against the slide 15.

When the waste products are compressed in the press chamber 9, the liquid phase is squeezed out of the raw waste products through the calibrated passages provided in the sleeve 12 and discharged through the funnel 13. Further, the leakages of liquid phase flowing through the outlet opening 11 in the discharging chamber 14 are received by the box 21 and discharged through the orifice 22 (FIG. 3).

When pressing of the waste products is completed, the slide 15 is raised by the action of the jack 16 so as to open the outlet opening 11 of the pressing chamber 9, and the flap 24 swings over so as to close the orifice 22 and open the opening 23 of the box 21.

Figure 4:
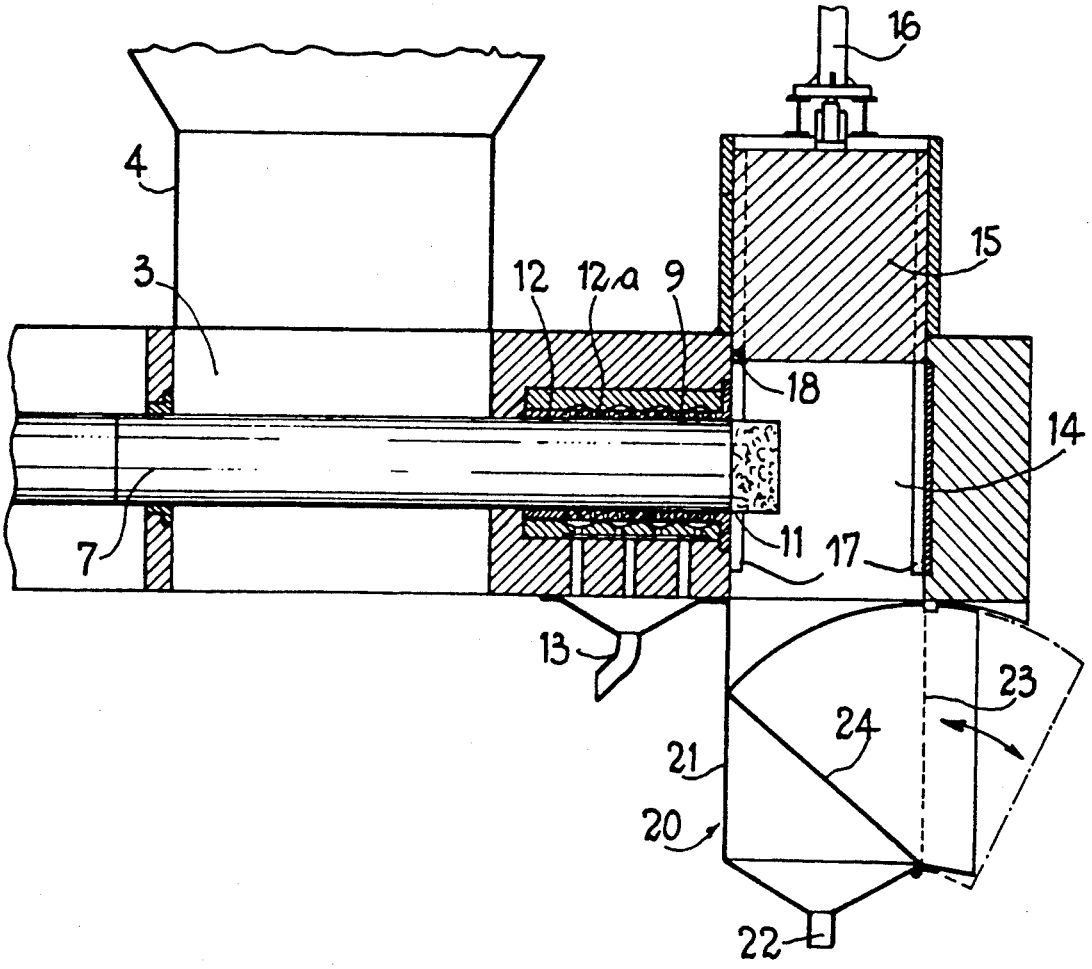
Figure 5:
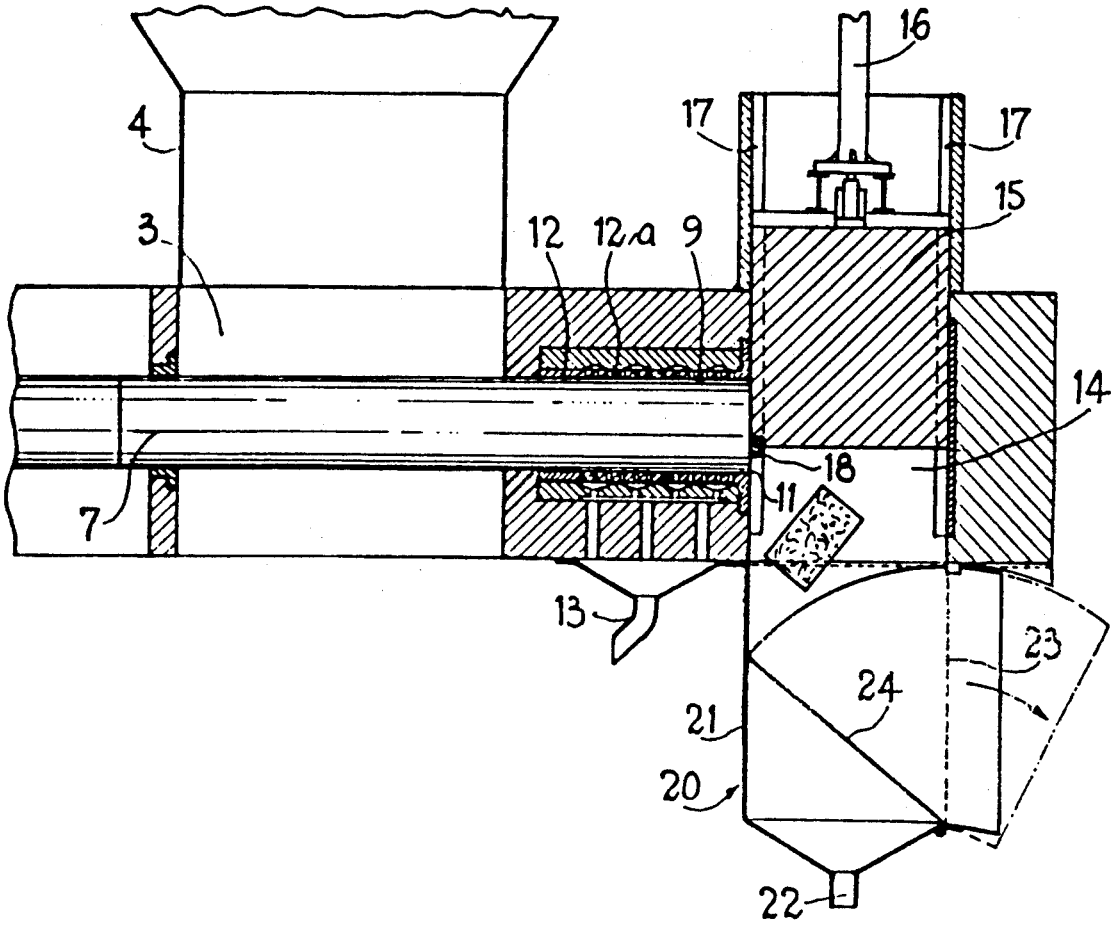

By the advance of the piston 7 in the press chamber 9, the solid and dry parts of the waste products are caused to leave the press chamber and then, by the descent of the slide 15, these solid parts are urged against the flap 24 so as to discharge them through the opening 23 (FIGS. 4 and 5).

Owing to the effect of the blades 18, the slide 15 in its downward movement acts as a shear, in the event of wedging of the solid parts, and cleans the walls of the discharging chamber 14.

When the solid parts have been discharged, the piston 7 returns to its initial position for a new cycle of operation similar to the preceding cycle.

This system has the advantage of avoiding the need for a seal for closing the outlet opening of the pressing chamber, owing to the fact that the dry products are made to travel outside the zone for recovering leakages of the liquid phase.

Further, this system also has the advantage of avoiding any element for achieving a counter-pressure at the moment of pressing of the waste products.

What is claimed is:

1. Press for treating heterogeneous waste products comprising a solid phase and a liquid phase, said press comprising (a) a frame;

(b) means defining a feed zone of receiving said waste products, said feed zone having a feed axis and being open adjacent to an upper end thereof and defining two opposed lateral openings, a compression piston movable between one of said openings of said feed zone and a position located beyond the other of said openings, said lateral openings having a section adapted to a corresponding section of said piston;

(c) a press chamber having a pressing axis and comprising an inlet opening and an outlet opening which are in opposed relation to each other and disposed coaxially relative to said feed axis of said feed zone, said chamber having a section equal to a section of said compression piston, means for recovering said liquid phase, said press chamber comprising calibrated passages connecting said press chamber with said liquid phase recovering means;

(d) a chamber for discharging said solid phase located downstream of said press chamber relative to a direction of flow of said waste products through said press chamber;

(e) an element having a shape complementary to a shape of said discharging chamber and movable transversely relative to said pressing axis of said press chamber between a first position for closing said outlet opening of said press chamber during compression of said waste products by means of said compression piston, and a second position for opening said outlet opening for extracting by means of said compression piston said solid phase from said press chamber; and (f) means for separating leakages of said liquid phase from said solid phase in said solid phase discharging chamber.

2. Press according to claim 1, wherein said transversely movable element comprises a slide, said press further comprising a jack for controlling said slide and slideways connected to said frame for guiding said slide.

3. Press according to claim 2, wherein a lower part of said slide comprises blades for cleaning walls of said discharging chamber.

4. Press according to claim 1, wherein said separating means comprise a pivotable flap.

5. Press according to claim 4, wherein said flap is pivotable between a first position for placing said discharging chamber in communication with means for recovering said leakages of said liquid phase during compression of said water products in said press chamber, and a second position for placing said discharging chamber in communication with means for recovering said solid phase during extraction of said solid phase from said press chamber.

* * * * *